United States Patent [19]

Honkura et al.

[11] Patent Number: 4,714,502

[45] Date of Patent: Dec. 22, 1987

[54] SOFT MAGNETIC STAINLESS STEEL FOR COLD FORGING

[75] Inventors: Yoshinobu Honkura, Konan; Kouji Murata; Takashi Yokoyama, both of Tokai, all of Japan

[73] Assignee: Aichi Steel Works, Ltd., Aichen, Japan

[21] Appl. No.: 886,675

[22] Filed: Jul. 18, 1986

[30] Foreign Application Priority Data

Jul. 24, 1985 [JP] Japan ..... 60-163747

[51] Int. Cl.[4] ..... C22C 38/28

[52] U.S. Cl. ..... 148/307; 420/41; 420/70; 420/103

[58] Field of Search ..... 148/306, 307; 420/41, 420/70, 34, 103

[56] References Cited

U.S. PATENT DOCUMENTS

| | | | |
|---|---|---|---|
| 3,165,367 | 10/1971 | Tanczyn | 420/41 |
| 4,155,752 | 5/1979 | Oppenheim et al. | 420/41 |
| 4,347,080 | 8/1982 | Yanagida et al. | 420/41 |
| 4,465,525 | 8/1984 | Yoshimura et al. | 420/41 |

FOREIGN PATENT DOCUMENTS

| | | |
|---|---|---|
| 51-8736 | 3/1976 | Japan . |
| 51-8740 | 3/1976 | Japan . |
| 58-14870 | 3/1983 | Japan . |
| 232258 | 12/1984 | Japan . |

*Primary Examiner*—L. Dewayne Rutledge
*Assistant Examiner*—Deborah Yee
*Attorney, Agent, or Firm*—Oblon, Fisher, Spivak, McClelland, & Maier

[57] ABSTRACT

A soft magnetic stainless steel consists essentially of, by weight, up to 0.03% of C, 0.40 to 1.10% of Si, up to 0.50% of Mn, 9.0 to 19.0% of Cr, 0.31 to 0.60% of Al, 0.01 to 0.03% of S, 0.10 to 0.30% of Pb, 0.02 to 0.25% of Ti, 0.02 to 0.10% of Zr, and up to 0.03% of N, and the balance of Fe and inevitable impurities, with a proviso that the C+N content is not more than 0.04% and the Si+Al content is not more than 1.35%. The steel has a magnetic flux density of 13,000 G or more and a coercive force of 1.2 Oe or less as magnetic properties, and a tensile strength of 41 kgf/mm$^2$ or less and a critical compressibility of 50% or more as formability in cold forging. The steel is suitable for manufacturing, by cold forging, parts with complex shapes such as cores of solenoid operated valves and electromagnetic clutches, and bodies of electronic fuel injection apparatuses for internal combustion engines.

6 Claims, 4 Drawing Figures

SOFT MAGNETIC STAINLESS STEEL FOR COLD FORGING

BACKGROUND OF THE INVENTION

1. Field of the Invention

The present invention relates to a soft magnetic stainless steel for cold forging, having excellent formability in cold forging, machinability, electrical and magnetic properties, and corrosion resistance, and suitable for use as a material for stationary cores and movable cores of solenoid operated valves and electromagnetic clutches, and bodies of electronic fuel injection apparatuses for internal combustion engines.

2. Description of the Prior Art

Conventionally, soft magnetic stainless steels must have prescribed magnetic properties (e.g., magnetic flux density, and coercive force), electrical resistance, corrosion resistance, machinability, and the like. In order to obtain particularly excellent magnetic properties, 2Si-13Cr steels, 1Si-0.20Al-13Cr steels, and the like have been proposed and some of them have been put into practical use. The application field of soft magnetic stainless steels has recently been widened, and more soft magnetic stainless steels are applied to parts having complex shapes such as bodies of electronic fuel injection apparatuses and cores of solenoid operated valves and electromagnetic clutches. In view of this, a demand has arisen for a soft magnetic stainless steel which has excellent formability in cold forging and excellent machinability in addition to other properties as mentioned above.

In response to this demand, for example, a steel has been proposed wherein the C content in a 1Si-13Cr-0.2Al steel or the like is reduced to about 0.01%, and 0.018% of S and 0.2% of Pb are added, and some of such steels have already been put into practical use.

These steels, however, still do not have completely satisfactory formability in cold forging; they have a tensile strength of 44.5 kgf/mm$^2$, a reduction of area of 74%, and a critical compressibility of 47%. Therefore, these steels cannot be subjected to cold forging for manufacturing parts having complex shapes such as bodies of electronic fuel injection apparatuses. Accordingly, a soft magnetic stainless steel having both excellent formability in cold forging and machanability and excellent electrical and magnetic properties has been desired.

SUMMARY OF THE INVENTION

It is a primary object of the present invention to provide a soft magnetic stainless steel which has an improved formability in cold forging and still has excellent electrical and magnetic properties.

It is another object of the present invention to provide a soft magnetic stainless steel which has an excellent formability in cold forging (a tensile strength of 40 kgf/mm$^2$ or less and a critical compressibility of 50% or more) and which also has excellent corrosion resistance, electrical resistance, and machinability.

It is still another object of the present invention to provide a soft magnetic stainless steel which has excellent magnetic properties, i.e., a magnetic flux density of 13,000 G or more and a coercive force of 1.2 Oe or less.

It is a further object of the present invention to provide a soft magnetic stainless steel which is suitable for use as a material for manufacturing by cold forging parts with complex shapes, such as cores of solenoid operated valves and electromagnetic clutches, or bodies of electronic fuel injection apparatuses for internal combustion engines.

The soft magnetic stainless steel according to the present invention consists essentially of, by weight, up to 0.03% of C, 0.04 to 1.10% of Si, up to 0.05% of Mn, 9.0 to 19.0% of Cr, 0.31 to 0.60% of Al, 0.010 to 0.030% of S, 0.10 to 0.30% of Pb, 0.02 to 0.25% of Ti, 0.02 to 0.10% of Zr, and up to 0.03% of N, and the balance of Fe and inevitable impurities, with a proviso that the C+N content is not more than 0.04% and the Si+Al content is not more than 1.35%.

The soft magnetic stainless steel according to the present invention may further contain, in addition to the above-mentioned constituents, a member or member selected from the group consisting of up to 2.5% of Mo, up to 0.5% of Cu, and up to 0.5% of Ni, whereby corrosion resistance of the above steel can be further improved.

The soft magnetic stainless steel according to the present invention may further contain, in addition to the above-mentioned constituents of the first named steel, a member or members selected from the group consisting of 0.010 to 0.050% of Se, 0.002 to 0.02% of Ca, and 0.01 to 0.20% of Te, whereby machinability of the first named steel can be further improved.

BRIEF DESCRIPTION OF THE DRAWINGS

Various other objects, features and attendant advantages of the present invention will be more fully appreciate as the same becomes better understood from the following detailed description when considered in connection with the accompanying drawings in which.

DETAILED DESCRIPTION OF THE PREFERRED EMBODIMENTS

Figure 1:
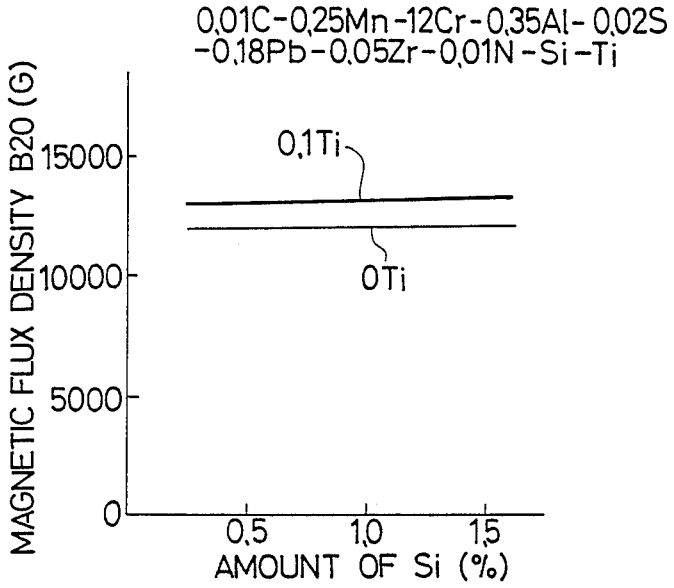
FIG. 1 is a graph showing the relationship between the Si content and the magnetic flux density of a steel when the Ti content is fixed at two different values.

The present invention relates to a soft magnetic stainless steel which has excellent magnetic properties, formability in cold forging, machinability, corrosion resistance, and electrical resistance which are improved over those of conventional 13Cr steels.

The present inventors investigated the effects of various alloying elements on the magnetic properties, electrical properties, formability in cold forging, and machinability in 13Cr steels. As a result, they have found the followings: (1) magnetic properties can be improved by adding Si, Al and Ti and lowering the C+N content; (2) electrical properties can be markedly improved by adding both Si and Al and synergetic effect thereof; (3) formability in cold forging can be improved by adding Ti and lowering the C+N content; and (4) machinability can be markedly improved by adding small amounts of S and Pb. Although an addition in large amounts of Si and Al significantly impairs formability in cold forging, an addition of 0.10 to 0.30% of Pb impairs only slightly formability in cold forging. Finally, an addition of Zr in an amount 1.5 to 4 times that of S cancels influence of addition of S in formability in cold forging.

When the C+N content is about 0.06% which is a normal value of C+N content in the conventional soft magnetic stainless steels, an addition of Ti does not provide any significant improvement in formability in cold forging and provides only slight improvements in magnetic propreties. However, in an extremely low C+N content range of 0.04% or less, an addition of about 0.1% of Ti significantly improves magnetic properties and formability in cold forging of the steel.

When the C+N content is considerably high, if all C+N is fixed with Ti, large TiC and TiN grains are precipitated and formability in cold forging is impaired. However, when the C+N content is very low, i.e., 0.04% or less, if all C+N is fixed with Ti, only small and harmless TiC and TiN grains are precipitated. Then, only the C+N interstitial solid solution reinforcement effect is cancelled, so that formability in cold forging and magnetic properties are markedly improved.

Based on the above findings, the present inventors had previously proposed in U.S. patent application Ser. No. 851,159, filed on Apr. 14, 1986, a soft magnetic stainless steel consisting essentially of, by weight, up to 0.03% of C, 2.0 to 3.0% of Si, up to 0.40% of Mn, 0.015 to 0.050% of S, 10 to 13% of Cr, 0.05 to 0.20% of Ti, up to 0.03% of N, up to 0.010% of Al, and the balance of Fe and inevitable impurities, with a proviso that the C+N content is not more than 0.05%. The steel has a maximum permeability of not less than 4,400 and a magnetic flux density of not less than 12,000 G as magnetic properties, together with a fatigue strength after welding of not lower than 120 kgf/mm$^2$, retains the magnetic properties even after annealing at a high temperature of 920° C., and is excellent in electrical resistance, corrosion resistance, mechanical properties and machinability. However, since this steel has an Si content lower limit of 2.0% in order to improve electrical properties and an Al-content upper limit of 0.01% in order to improve the fatigue strength after welding, it has poor formability in cold forging.

In view of the above, according to the present invention, the C+N content of a 13Cr steel is set to be not more than 0.04%, the Si content is set to be in the range of 0.4 to 1.10%, the Al content is set to be in the range of 0.31 to 0.60%, and the Ti content is set to be 0.02 to 0.25%, thereby improving the electrical and magnetic properties as well as formability in cold forging. The steel further contains 0.010 to 0.030% of S, 0.10 to 0.30% of Pb, and 0.02 to 0.10% of Zr, whereby machinability is improved while excellent formability in cold forging is retained. Therefore, the steel according to the present invention is a soft magnrtic stainless steel for cold forging, which has excellent magnetic properties (a magnetic flux density (B20) of 13,000 G or more, and a coercive force of 1.2 Oe or less), excellent electrical properties (a specific resistance of 70 $\mu\Omega$-cm or more, excellent formability in cold forging (a tensile strength of 41.0 kgf/mm$^2$ or less and a critical compressibility of 50% or more), and excellent machinability equivalent to that of SUS 416 (Japanese Industrial Standard) or higher, and which is suitable for use as a material for manufacturing by cold forging cores of solenoid operated valves and electromagnetic clutches, and bodies of electronic fuel injection apparatuses for internal combustion engines.

The grounds for limitations on the composition of the steel according to the present invention will now be explained below.

C is an element which impairs formability in cold forging by the solid solution reinforcement effect and adversely affects magnetic properties. In the present invention, therefore, the C content is desirably as low as possible, and the upper limit thereof is set to be 0.03%. For further improvement of formability in cold forging and magnetic properties, it is desirable to limit the C content to 0.015% or below.

Si is an element which improves magnetic properties such as maximum permeability, magnetic flux density and coercive force and increases electrical resistance; thus Si is an important constituent of the soft magnetic steel, and should be incorporated in an amount of not less than 0.04%.

However, since Si also impairs formability in cold forging due to the solid solution reinforcement effect, its upper limit is set to be 1.10%.

Mn, like Si, is an element necessary for deoxidation in the steel making process, and the Mn content is set in such a range as not to impair magnetic properties, the upper limit thereof being 0.50%.

Cr is a primary element which provides the corrosion resistance characteristics of the stainless steels, and should be incorporated in the steel in an amount of at least 9.0%.

However, an increase in the Cr content impairs the magnetic propeties such as magnetic flux density. Therefore, the upper limit of Cr content is set to be 19.0%. In order to further improve magnetic properties, the Cr content is preferably set to be 14.0% or below.

Al is an element which improves magnetic properties and electrical resistance. With the synergetic effect with addition of Al together with Si, Al markedly improves electrical resistance. In order to obtain a sufficient effect of addition of Al, it must be added in an amount of at least 0.31%, and therefore the lower limit of Al content is 0.31%.

However, if Al is added in an amount exceeding 0.60%, the excellent formability in cold forging obtained according to the present invention is impaired. Therefore, the upper limit of the Al content is set to be 0.60%.

S is an element which markedly improves machinability by addition in a small amount but must be incorporated in an amount of at least 0.010%. However, too high a S content leads to lower formability in cold forging and lower corrosion resistance, and therefore, the upper limit of S content is set to be 0.030%.

Pb is an element which improves machinability, and an addition of Pb together with S provides a particularly good machinability. Although Pb must be added in an amount of at least 0.10%, too high a Pb content leads to low formability in cold forging and hot rolling. Therefore, the upper limit of Pb content is set to be 0.30%.

Ti greatly improves magnetic properties such as maximum permeability, magnetic flux density, and coercive force. In a very low C+N content range of 0.04% or below, Ti fixes C+N on fine carbonitrides, thereby significantly improving formability in cold forging such as tensile strength and critical compressibility. Ti is the most important element according to the present invention. In order to obtain an effect of addition, Ti must be added in an amount of at least 0.02%, and its lower limit is 0.02%.

For further improvement of magnetic properties and formability in cold forging, Ti should be added in such an amount which is three times the C+N content, and preferably in an amount of 0.05% or more.

However, an addition of more than 0.25% of Ti leads only to saturation of the advantage. Thus, the upper limit of Ti content is set to be 0.25%.

Zr is an element which produces spherical MnS grains and improves formability in cold forging. Zr must be added in an amount of at least 0.02%. However, an addition of Zr in too large an amount leads to an increase in the amount of inclusions and impaires formability in cold forging. Therefore, the upper limit of Zr is set to be 0.10%.

N, like C, is an element which impairs formability in cold forging by the solid solution reinforcement effect, and its content is preferably reduced as low as possible according to the present invention. The upper limit of N content is set to be 0.03%.

In order to further improve formability in cold forging, the N content is preferably 0.020% or below.

Both C and N are elements which impair formability in cold forging by the solid solution reinforcement effect. Since the object of the present invention is to provide a soft magnetic steel having excellent formability in cold forging (a tensile strength of 41.0 kgf/mm$^2$ or less and a critical compressibility of 50% or more), the C+N content must be reduced as low as possible. Therefore, the upper limit of the C+N content is set to be 0.04%.

Both Si and Al are element which improve magnetic and electrical properties. However, an addition of these elements in too large amounts leads to impaire formability in cold forging. Since the object of the present invention is to provide a steel having excellent formability in cold forging, the upper limit of the Si+Al content is set to be 1.35%.

Mo, Cu and Ni are elements which improve corrosion resistance according to the present invention.

However, an addition of more than 2.5% of Mo and more than 0.5% of Cu or Ni, respectively, impairs magnetic properties and formability in cold forging. Therefore, the upper limit of Mo is set to be 2.5%, and the upper limit for Cu or Ni is set to be 0.5%.

Se, Ca and Te are elements which improve machinability. To obtain excellent machinability, not less than 0.010% of Se, not less than 0.002% of Ca, and not less than 0.01% of Te must be incorporated in the steel. The lower limits of Se, Ca and Te contents are 0.010%, 0.002%, and 0.01%, respectively.

An addition of more than 0.20% of Te impairs magnetic properties and formability in cold forging. An addition of more than 0.050% of Se impairs corrosion resistance and formability in cold forging. An addition of more than 0.02% of Ca impairs formability in cold forging. Therefore, the upper limit of Se content is set to be 0.050%, and the upper limit of Ca or Te content is set to be 0.20%, respectively.

The characteristic features of the steel according to the present invention will be made clear in comparison with conventional steels and comparative steels in the following description of examples.

Table 1 shows the chemical composition of the test steels used in the comparison test.

TABLE 1

| | Chemical composition (% by weight) | | | | | | | | | | | | | | |
|---|---|---|---|---|---|---|---|---|---|---|---|---|---|---|---|
| Steels | C | Si | Mn | Cr | Al | S | Pb | Ti | Zr | N | Mo | Cu | Ni | Se, Ca, Te | C + N |
| A | 0.010 | 0.80 | 0.25 | 12.02 | 0.35 | 0.020 | 0.18 | 0.08 | 0.05 | 0.012 | | | | | 0.022 |
| B | 0.011 | 0.82 | 0.24 | 12.11 | 0.36 | 0.015 | 0.17 | 0.07 | 0.03 | 0.012 | | | | | 0.023 |
| C | 0.010 | 0.81 | 0.23 | 12.09 | 0.34 | 0.027 | 0.19 | 0.08 | 0.07 | 0.011 | | | | | 0.021 |
| D | 0.011 | 0.80 | 0.23 | 11.98 | 0.35 | 0.020 | 0.12 | 0.06 | 0.05 | 0.009 | | | | | 0.020 |
| E | 0.010 | 0.81 | 0.23 | 11.75 | 0.35 | 0.019 | 0.27 | 0.08 | 0.04 | 0.009 | | | | | 0.019 |
| F | 0.010 | 0.79 | 0.25 | 12.11 | 0.37 | 0.020 | 0.18 | 0.03 | 0.05 | 0.008 | | | | | 0.018 |
| G | 0.009 | 0.82 | 0.24 | 12.05 | 0.34 | 0.020 | 0.18 | 0.09 | 0.04 | 0.009 | | | | | 0.018 |
| H | 0.010 | 0.52 | 0.24 | 13.18 | 0.52 | 0.020 | 0.18 | 0.08 | 0.04 | 0.009 | | | | | 0.019 |
| J | 0.010 | 0.91 | 0.23 | 11.22 | 0.32 | 0.018 | 0.17 | 0.08 | 0.04 | 0.011 | | | | | 0.021 |
| K | 0.009 | 0.81 | 0.24 | 12.07 | 0.35 | 0.019 | 0.18 | 0.08 | 0.05 | 0.012 | 0.82 | | | | 0.021 |
| L | 0.009 | 0.80 | 0.24 | 12.17 | 0.35 | 0.020 | 0.17 | 0.08 | 0.05 | 0.011 | | 0.32 | | | 0.020 |
| M | 0.010 | 0.80 | 0.24 | 11.89 | 0.35 | 0.021 | 0.19 | 0.07 | 0.05 | 0.010 | | | 0.25 | | 0.020 |
| N | 0.011 | 0.83 | 0.25 | 11.92 | 0.37 | 0.021 | 0.18 | 0.07 | 0.05 | 0.010 | 0.52 | 0.24 | | | 0.021 |
| P | 0.010 | 0.79 | 0.24 | 12.01 | 0.35 | 0.011 | 0.17 | 0.07 | 0.05 | 0.010 | | | | Se 0.012 | 0.020 |
| Q | 0.010 | 0.78 | 0.24 | 12.00 | 0.34 | 0.015 | 0.18 | 0.08 | 0.04 | 0.010 | | | | Ca 0.0030 | 0.020 |
| R | 0.010 | 0.80 | 0.24 | 12.09 | 0.35 | 0.011 | 0.18 | 0.08 | 0.04 | 0.009 | | | | Te 0.013 | 0.019 |
| S | 0.011 | 0.82 | 0.24 | 12.01 | 0.35 | 0.011 | 0.18 | 0.08 | 0.05 | 0.009 | | | | Se 0.011<br>Te 0.012 | 0.020 |
| T | 0.010 | 0.82 | 0.25 | 11.93 | 0.32 | 0.016 | 0.15 | 0.05 | | 0.011 | | | | | 0.021 |
| U | 0.011 | 0.80 | 0.24 | 12.07 | 0.35 | 0.013 | | 0.07 | 0.03 | 0.011 | | | | | 0.022 |
| V | 0.010 | 0.84 | 0.24 | 11.76 | 0.34 | 0.018 | 0.17 | 0.01 | 0.05 | 0.012 | | | | | 0.022 |
| W | 0.020 | 0.93 | 0.26 | 13.40 | 0.22 | 0.005 | 0.09 | 0.01 | | 0.021 | | | | | 0.041 |
| X | 0.020 | 0.91 | 0.26 | 13.48 | 0.20 | 0.003 | 0.11 | 0.01 | | 0.022 | 0.50 | | | Te 0.030 | 0.042 |
| Y | 0.020 | 0.94 | 0.28 | 12.78 | 0.24 | 0.016 | 0.18 | 0.01 | | 0.015 | | | | | 0.035 |

In Table 1, steels A to S are steels according to the present invention, steels T to V are comparative steels, and steels W to Y are conventional steels.

Table 2 shows tensile strength, critical compressibility, magnetic flux density, coercive force, corrosion resistance, specific resistance, and machinability of the test steels A to Y in Table 1, which have been subjected to a heat treatment comprising heating at 900° C. for 2 hours followed by cooling at a rate of 100° C./Hr.

The tensile strength was measured by using JIS No. 4 specimens. The critical compressibility was determined by performing a compression test using notched round rods having a diameter of 14 mm and a length of 21 mm as specimens and measuring the upsetting ratio at a cracking rate of 50%, in accordance with the cold upsetting performance test (temporary standards) as provided by the Committee of Cold Forging of the Japanese Society of Plastic Rolling. As magnetic properties, magnetic flux density and coercive force were measured by using a DC-type BH tracer and ring specimens of 24 mm in outer diameter, 16 mm in inner diameter, and 16 mm in thickness.

As for corrosion resistance, salt spray tests were carried out by using a 5% aqueous NaCl solution (35° C.), and the degree of rusting was determined. Specimens with degrees of rusting of below 5% are marked with ⊙, and those with degrees of rusting of 5 to 25% are marked with ○. The electrical resistance was determined by the Wheatstone bridge method using 1.2 mm diameter×500 mm long wires as specimens.

Machinability was evaluated by drilling specimens of 10 mm thickness with a drill model SKH having a diameter of 5 mm at a rotational speed of 725 rpm and a load of 4 kg and measuring the time required for drilling holes.

TABLE 2

| | Tensile strength (kg · f/mm²) | Critical compressibility (%) | Magnetic flux density B20 (G) | Coercive force Hc (Oe) | Corrosion resistance | Specific resistance (μ Ω - cm) | Machinability (sec.) |
|---|---|---|---|---|---|---|---|
| A | 39 | 56 | 13,200 | 1.0 | ○ | 73 | 6.7 |
| B | 39 | 59 | 13,300 | 1.0 | ○ | 73 | 6.8 |
| C | 39 | 51 | 13,100 | 1.0 | ○ | 73 | 6.5 |
| D | 40 | 57 | 13,300 | 1.0 | ○ | 73 | 7.1 |
| E | 38 | 55 | 13,200 | 1.0 | ○ | 73 | 6.4 |
| F | 40 | 54 | 13,000 | 1.0 | ○ | 73 | 6.7 |
| G | 38 | 56 | 13,300 | 0.9 | ○ | 73 | 6.8 |
| H | 38 | 56 | 13,200 | 0.9 | ○ | 74 | 6.7 |
| J | 40 | 56 | 13,200 | 0.9 | ○ | 75 | 6.7 |
| K | 40 | 54 | 13,900 | 1.1 | ⊙ | 74 | 6.7 |
| L | 40 | 54 | 13,000 | 1.1 | ⊙ | 74 | 6.8 |
| M | 40 | 54 | 13,000 | 1.1 | ⊙ | 74 | 6.9 |
| N | 40 | 54 | 13,000 | 1.1 | ⊙ | 74 | 6.9 |
| P | 39 | 57 | 13,100 | 1.1 | ○ | 73 | 6.6 |
| Q | 39 | 57 | 13,300 | 1.1 | ○ | 73 | 6.6 |
| R | 39 | 57 | 13,200 | 1.1 | ○ | 73 | 6.5 |
| S | 39 | 56 | 13,200 | 1.1 | ○ | 73 | 6.3 |
| Y | 39 | 48 | 13,000 | 1.1 | ○ | 71 | 7.4 |
| U | 39 | 55 | 13,200 | 1.1 | ○ | 72 | 9.8 |
| V | 39 | 46 | 12,700 | 1.1 | ○ | 72 | 7.0 |
| W | 47 | 44 | 12,100 | 1.1 | ⊙ | 69 | 9.3 |
| X | 45 | 57 | 12,200 | 1.1 | ⊙ | 69 | 9.0 |
| Y | 42 | 45 | 12,200 | 1.1 | ○ | 69 | 7.0 |

As seen from Table 2, although the conventional steel W has an excellent corrosion resistance, it has poor magnetic property (a magnetic flux density of 12,100 G). Since the Ti content is low, the steel W also has poor formability in cold forging (a tensile strength of 47 kgf/mm² and a critical compressibility of 44%). In addition, the steel W has low specific resistance and poor machinability.

The steel X has low Al content (0.20%) and a low Ti content. Therefore, the steel X has unsatisfactory magnetic properties such as magnetic flux density and electrical properties, and it also has poor formability in cold forging (a tensile strength of 45 kgf/mm²). Further, due to the low S content, the steel X also has poor machinability. The steel Y, like the steel X, has low Al and Ti contents. Therefore, the Y steel similarly has poor electrical and magnetic properties and poor formability in cold forging.

The comparative steel T does not contain Zr, and therefore has poor formability in cold forging and poor machinability. Since the steel U does not contain Pb, it has unsatisfactory machinability. The V steel has a low Ti content, and has poor magnetic properties, formability in cold forging, and corrosion resistance.

As contrasted to the above steels, the steels A to S according to the present invention are characterized by the reduced C and N contents which upon incorporation degrade formability in cold forging by the solid solution reinforcement effect, a Ti content of 0.02 to 0.25%, a Si content of 0.40 to 1.10%, an Al content of 0.31 to 0.60%, a Mn content of 0.50% or below, a Cr content of 9.0 to 19.0%, a S content of 0.010 to 0.030%, a Pb content of 0.10 to 0.30%, and a Zr content of 0.02 to 0.10%. As a result of such compositions, these steels have excellent formability in cold forging (a tensile strength of 40 kgf/mm² or less and a critical compressibility of 50% or more), excellent magnetic properties (a magnetic flux density of 13,000 G or more and a coercive force of 1.2 Oe or less), and excellent corrosion resistance, electrical resistance, and machinability.

Improvements in magnetic and electrical properties and formability in cold forging in the steels according to the present invention will be described with reference to the accompanying drawings.

FIG. 1 is a graph showing the relationship between the Si content and the magnetic flux density B20 when the Ti content is fixed at two different values in a steel containing 0.01% of C, 0.25% of Mn, 12% of Cr, 0.35% of Al, 0.02% of S, 0.18% of Pb, 0.05% of Zr, and 0.01% of N, Si, Ti, and the balance of Fe and inevitable impurities. As can be seen from FIG. 1, when the Si content is within the range of 0.4 to 1.5% and the Ti content is about 0.1%, magnetic flux density is significantly increased over that of the case wherein the Ti content is zero.

Figure 2:
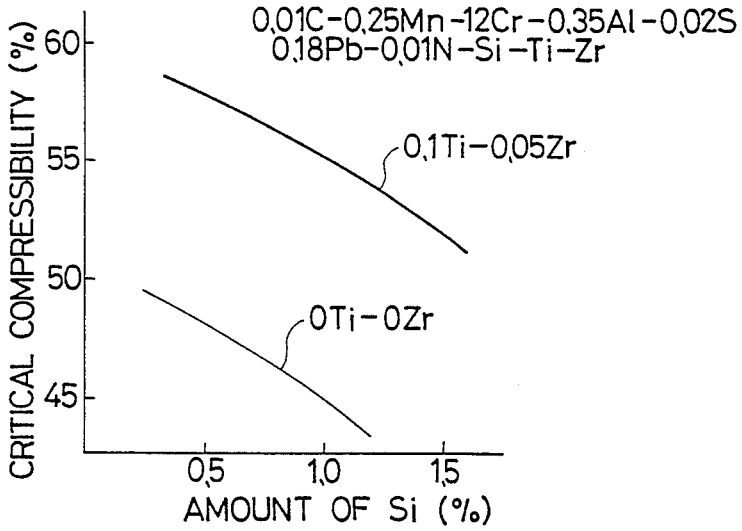
FIG. 2 is a graph showing the relationship between the Si content and the critical compressibility of a steel when the Ti and Zr contents are fixed at two different values.

FIG. 2 is a graph showing the relationship between the Si content and the critical compressibility when the Ti and Zr contents are fixed at two different values in a steel containing 0.01% of C, 0.25% of Mn, 12% of Cr, 0.35% of Al, 0.02% of S, 0.18% of Pb, 0.01% of N, Si, Ti, Zr, and the balance of Fe and inevitable impurities. As can be seen from FIG. 2, as the Si content increases, the critical compressibility of steel is reduced. However, when the steel contains about 0.1% of Ti and about 0.05% of Zr, the critical compressibility is significantly improved over the case wherein the steel contains no Ti and Zr.

Figure 3:
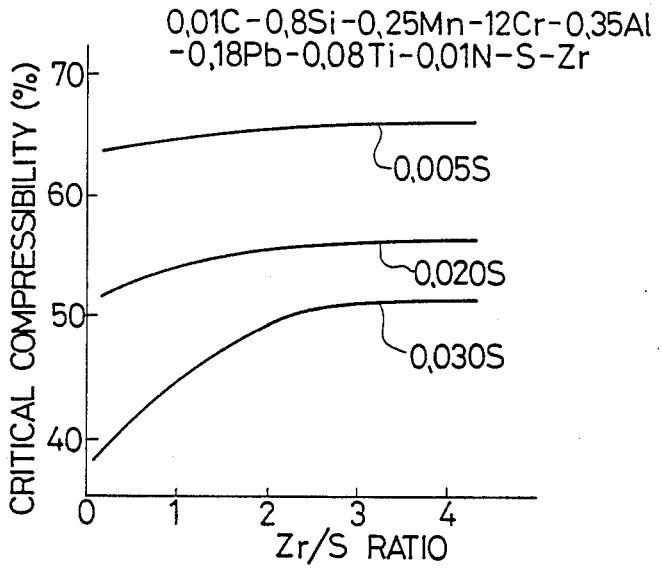
FIG. 3 is a graph showing the relationship between the critical compressibility and Zr/S ratio when the S content is fixed at three different values.

FIG. 3 shows the relationship between the Zr/S ratio and the critical compressibility when the S and Zr contents are fixed at three different values in a steel containing 0.01% of C, 0.8% of Si, 0.25% of Mn, 12% of Cr, 0.35% of Al, 0.18% of Pb, 0.08% of Ti, 0.01% of N, S, Zr, and the balance of Fe and inevitable impurities. As can be seen from FIG. 3, when the Zr/S ratio is within the range of 1 to 4, as the S content increases, the critical compressibility is reduced. When the S content is about 0.020%, a critical compressibility of 50% or more can be obtained.

Figure 4:
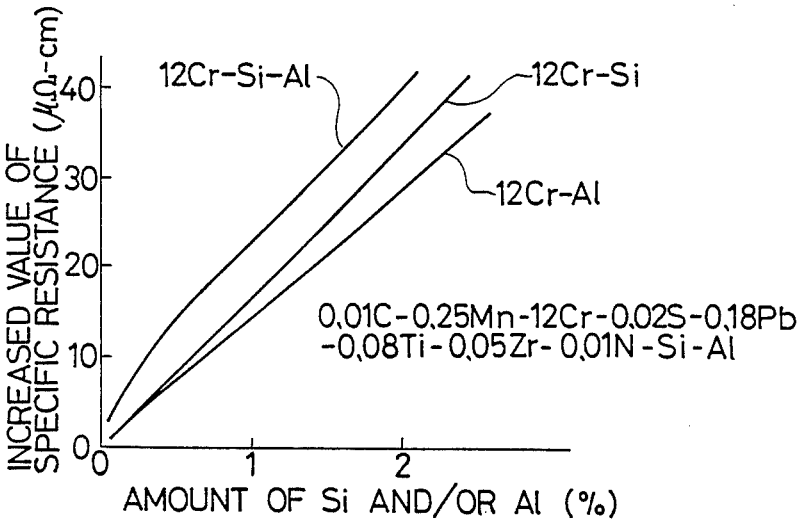
FIG. 4 is a graph showing the amount of Si and/or Al and the increase in specific resistance when both Si and Al are added, only Si is added, and only Al is added, respectively.

FIG. 4 is a graph showing the relationship between the amount of Si and/or Al and the increased value of specific resistance when both Si and Al are added, only Si is added, and only Al is added, respectively, in a steel containing 0.01% of C, 0.25% of Mn, 12% of Cr, 0.02% of S, 0.18% of Pb, 0.08% of Ti, 0.05% of Zr, 0.01% of N, Si and or Al, and the balance of Fe and inevitable impurities. As can be seen from FIG. 4, when both Si and Al are added together, the increase in the specific resistance is larger than the cases wherein only Si or only Al is added, respectively.

In summary, according to the present invention, the C and N contents are reduced to minimum, a suitable amount of Ti is added, and upper limits of the Si and Mn contents are controlled, whereby the formability in cold forging is improved without impairing magnetic properties. An addition of S, Pb and Zr improves machinability without impairing formability in cold forging. An addition of prescribed amounts of Cr and Ti improves corrosion resistance. The steel according to the present invention is a soft magnetic stainless steel for cold forging, which is suitable for use as a material for manufacturing, by cold forging, cores of solenoid operated valves and electromagnetic clutches, or bodies of electronic fuel injection apparatuses for internal combustion engines.

What is claimed as new and desired to be secured by Letters Patent of the United States is:

1. A soft magnetic stainless steel having a magnetic flux density of not less than 13,000 G, a tensile strength of not more than 41 kgf/mm$^2$ and a critical compressibility of not less than 50% in cold forging, consisting essentially of, by weight, up to 0.03% of C, 0.40 to 1.10% of Si, up to 0.50% of Mn, 9.0 to 19.0% of Cr, 0.31 to 0.60% of Al, 0.010 to 0.030% of S, 0.10 to 0.30% of Pb, 0.02 to 0.25% of Ti, 0.02 to 0.10% of Zr, and up to 0.03% of N, and the balance of Fe and inevitable impurities, with a proviso that the C+N content is not more than 0.040% and the Si+Al content is not more than 1.35%.

2. The steel according to claim 1 wherein the steel comprises, by weight, up to 0.015% of C, 0.40 to 1.10% of Si, up to 0.50% of Mn, 9.00 to 14.0% of Cr, 0.31 to 0.60% of Al, 0.010 to 0.030% of S, 0.10 to 0.30% of Pb, 0.05 to 0.25% of Ti, 0.02 to 0.10% of Zr and up to 0.30% of N.

3. A soft magnetic stainless steel having a magnetic flux density of not less than 13,000 G, a tensile strength of not more than 41 Kgf/mm$^2$ and a critical compressibility of not less than 50% in cold forging, consisting essentially of, by weight, up to 0.03% of C, 0.40 to 1.10% of Si, up to 0.50% of Mn, 9.0 to 19.0% of Cr, 0.31 to 0.60% of Al, 0.010 to 0.030% of S, 0.10 to 0.30% of Pb, 0.02 to 0.25% of Ti, 0.02 to 0.10% of Zr, up to 0.03% of N, at least one member selected from the group consisting of up to 2.5% of Mo, up to 0.5% of Cu and up to 0.5% of Ni, and the balance of Fe and inevitable impurities with a proviso that the C+N content is not more than 0.040% and the Si+Al content is not more than 1.35%.

4. The steel according to claim 3 wherein the steel comprises, by weight, up to 0.015% of C, 0.40 to 1.10% of Si, up to 0.50% of Mn, 9.00 to 14.0% of Cr, 0.31 to 0.60% of Al, 0.010 to 0.030% of S, 0.10 to 0.30% of Pb, 0.05 to 0.25% of Ti, 0.02 to 0.10% of Zr, up to 0.03% of N, and at least one member selected from the group consisting of up to 2.5% of Mo, up to 0.5% of Cu and up to 0.5% of Ni.

5. A soft magnetic stainless steel having a magnetic flux density of not less than 13,000 G, a tensile strength of not more than 41 Kgf/mm$^2$ and a critical compressibility of not less than 50% in cold forging, consisting essentially of, by weight, up to 0.03% of C, 0.40 to 1.10% of Si, up to 0.50% of Mn, 9.0 to 19.0% of Cr, 0.31 to 0.60% of Al, 0.010 to 0.030% of S, 0.10 to 0.30% of Pb, 0.02 to 0.25% of Ti, 0.02 to 0.10% of Zr, up to 0.03% of N, at least one member selected from the group consisting of 0.010 to 0.050% of Se, 0.002 to 0.02% of Ca and 0.01 to 0.20% of Te, and the balance of Fe and inevitable impurities, with a proviso that the C+N content is not more than 0.040% and the Si+Al content is not more than 1.35%.

6. The steel according to claim 5 wherein the steel comprises, by weight, up to 0.015% of C, 0.40 to 1.10% of Si, up to 0.50% of Mn, 9.00 to 14.0% of Cr, 0.31 to 0.60% of Al, 0.010 to 0.030% of S, 0.10 to 0.30% of Pb, 0.05 to 0.25% of Ti, 0.02 to 0.10% of Zr, up to 0.03% of N, and at least one member selected from the group consisting of 0.010 to 0.050% of Se, 0.002 to 0.02% of Ca and 0.01 to 0.20% of Te.

* * * * *